US010041668B2

(12) United States Patent
Korkmaz et al.

(10) Patent No.: US 10,041,668 B2
(45) Date of Patent: Aug. 7, 2018

(54) HYBRID HOMOGENOUS-CATALYTIC COMBUSTION SYSTEM

(71) Applicant: TUBITAK, Ankara (TR)

(72) Inventors: Özgür Can Korkmaz, Kocaeli (TR); Alper Sarioglan, Kocaeli (TR); Fehmi Akgün, Kocaeli (TR); Gaye Saglam, Kocaeli (TR); Hüseyin Çamkerten, Kocaeli (TR); Egemen Akar, Kocaeli (TR); Yildiz Sucu, Kocaeli (TR)

(73) Assignee: TUBITAK, Ankara (TR)

( * ) Notice: Subject to any disclaimer, the term of this patent is extended or adjusted under 35 U.S.C. 154(b) by 0 days.

(21) Appl. No.: 15/322,743

(22) PCT Filed: Jun. 26, 2015

(86) PCT No.: PCT/IB2015/054837
§ 371 (c)(1),
(2) Date: Dec. 29, 2016

(87) PCT Pub. No.: WO2016/001812
PCT Pub. Date: Jan. 7, 2016

(65) Prior Publication Data

US 2017/0153024 A1 Jun. 1, 2017

(30) Foreign Application Priority Data

Jun. 30, 2014 (TR) ..... a 2014 07615

(51) Int. Cl.

| | |
|---|---|
| ***F23C 13/06*** | (2006.01) |
| ***F23C 6/04*** | (2006.01) |
| ***F24H 1/12*** | (2006.01) |

(52) U.S. Cl.
CPC ..... *F23C 13/06* (2013.01); *F23C 6/042* (2013.01); *F24H 1/124* (2013.01)

(58) Field of Classification Search
CPC ..... F23C 13/06; F23C 6/042; F24H 1/124
(Continued)

(56) References Cited

U.S. PATENT DOCUMENTS 3,245,459 A * 4/1966 Keith ..... F23D 14/18 431/268
3,653,795 A * 4/1972 Villini ..... F23C 99/00 431/247

(Continued)

FOREIGN PATENT DOCUMENTS

DE 422711 C 12/1925
DE 3332572 A1 3/1985

(Continued)

*Primary Examiner* — Steven B McAllister
*Assistant Examiner* — John Bargero
(74) *Attorney, Agent, or Firm* — Gokalp Bayramoglu

(57) ABSTRACT

The present invention relates to a hybrid combustion system (1) wherein rich homogeneous combustion and lean catalytic combustion are carried out consecutively, which results in zero $NO_x$ emission and is used for obtaining domestic hot water. The present invention relates to a combustion system wherein two serially connected heat exchangers units, which are located in the outlets of the rich homogeneous combustion unit and the lean catalytic combustion unit, transfers the heat generated during combustion reactions into domestic radiator heating water and/or tap water for hot water generation.

20 Claims, 1 Drawing Sheet

(58) Field of Classification Search
USPC ..... 122/18.4; 431/5, 10, 267, 268; 126/263.01
See application file for complete search history.

(56) References Cited

U.S. PATENT DOCUMENTS

| | | | | |
|---|---|---|---|---|
| 4,444,735 | A * | 4/1984 | Birmingham | F23G 7/066 110/187 |
| 4,904,179 | A | 2/1990 | Drago et al. | |
| 5,052,919 | A | 10/1991 | Becker | |
| 5,195,884 | A | 3/1993 | Schwartz et al. | |
| 5,275,552 | A | 1/1994 | Schwartz et al. | |
| 5,464,006 | A | 11/1995 | Ledjeff et al. | |
| 5,476,375 | A | 12/1995 | Khinkis et al. | |
| 5,810,577 | A | 9/1998 | Ledjeff | |
| 5,851,489 | A | 12/1998 | Wolf et al. | |
| 6,138,586 | A * | 10/2000 | Reichart | F23G 7/065 110/211 |
| 6,302,683 | B1 * | 10/2001 | Vestin | B60H 1/22 431/170 |
| 6,431,856 | B1 | 8/2002 | Maenishi et al. | |
| 6,695,609 | B1 | 2/2004 | Chung et al. | |
| 7,198,482 | B2 | 4/2007 | Chung et al. | |
| 7,444,820 | B2 | 11/2008 | Colket, III | |
| 9,692,067 | B2 * | 6/2017 | Dong | H01M 8/04223 |
| 2003/0031971 | A1 * | 2/2003 | Sugimoto | F23C 13/00 431/268 |
| 2003/0186181 | A1 * | 10/2003 | Kang | F23C 13/00 431/7 |
| 2007/0241468 | A1 * | 10/2007 | Kammerzell | F28C 1/02 261/153 |
| 2008/0141675 | A1 * | 6/2008 | Liu | F23C 13/06 60/777 |
| 2008/0302013 | A1 * | 12/2008 | Repasky | B01J 12/007 48/127.9 |
| 2010/0126165 | A1 * | 5/2010 | Roychoudhury | F02G 1/043 60/517 |
| 2010/0313869 | A1 * | 12/2010 | Muntele | A41D 13/0051 126/208 |
| 2015/0318564 | A1 * | 11/2015 | Dong | C01B 3/323 429/423 |

FOREIGN PATENT DOCUMENTS

| | | | |
|---|---|---|---|
| DE | 4308017 | C1 | 8/1994 |
| DE | 4324012 | C1 | 1/1995 |
| DE | 4412714 | A1 | 10/1995 |
| DE | 19601957 | A1 | 7/1996 |
| DE | 19739704 | A1 | 3/1998 |
| DE | 29816864 | U1 | 1/2000 |
| EP | 0256322 | A1 | 2/1988 |
| EP | 0356709 | A2 | 3/1990 |
| EP | 0671586 | A1 | 9/1995 |
| EP | 0789188 | A2 | 8/1997 |
| EP | 1310737 | A2 | 5/2003 |
| WO | WO2010092150 | A1 | 8/2010 |

* cited by examiner

HYBRID HOMOGENOUS-CATALYTIC COMBUSTION SYSTEM

CROSS REFERENCE TO RELATED APPLICATIONS

This application is the national phase entry of International Application No. PCT/IB2015/054837, filed on Jun. 26, 2015, which is based upon and claims priority to Turkish Patent Application No. 2014/07615 filed on Jun. 30, 2014, the entire contents of which are incorporated herein by reference.

FIELD OF THE INVENTION

The present invention relates to a hybrid combustion system wherein rich homogeneous combustion and poor catalytic combustion are carried out consecutively, which results in zero $NO_x$ emission and is used for obtaining domestic hot water.

BACKGROUND OF THE INVENTION

Reducing $NO_x$ emissions inside waste gas emissions generated in gas fuel water heaters is highly important with respect to environment and human health. In combustion systems, nitrogen oxides are formed in three different ways. These are as follows: formation of $NO_x$ which consists of nitrogen sources provided in the content of liquid or solid fuel, formation of $NO_x$ which are generated in the flame instantly but in small amounts and formation of thermal $NO_x$ at high temperatures.

Fuel-based $NO_x$ emission is generated as a result of reaction of the nitrogen included in the fuel content and the oxygen provided in the combustion air. No such problem is confronted in gas fuels. However, approximately half of total $NO_x$ emissions in solid and liquid fuels may be originated from nitrogen provided in the content of the fuel.

Formation of prompt $NO_x$ is constituted as a result of a fast reaction occurring between nitrogen present in the air and hydrocarbon radicals. Portion of these kind of $NO_x$ emissions inside total $NO_x$ emissions is quite low.

Thermal $NO_x$ formation occurs as a result of reaction of oxygen and nitrogen in combustion air at flame temperatures over particularly 1200° C. Thermal $NO_x$ emission increases very quickly as flame temperature increases. A great majority of $NO_x$ emissions released as a result of combustion of gas fuels occur in this way.

In the commercial natural gas water heating systems homogeneous combustion process is utilized as the combustion technology. High flame temperatures are reached under stoichiometric conditions during homogeneous combustion of natural gas. Thermal $NO_x$ formation takes place depending on high temperature under these conditions. The most efficient ways to reduce $NO_x$ emissions in combustion systems with gas fuels is to reduce the flame peak temperature and the residence time at these peak temperatures. Therefore, the systems used are mostly operated by excess air. In addition, secondary air supply can be provided to the combustion chamber in order to reduce flame peak temperature. Alternatively, formation of $NO_x$ can be prevented by reducing the flame temperature by absorbing thermal energy from flame by means of an appropriate apparatus at a suitable absorption rate.

Another method used in order to reduce $NO_x$ emissions is to start the homogeneous combustion process by rich fuel mixture and then to complete the combustion process by poor fuel mixture gradually. Combustion process is carried out consecutively in consecutive zones from rich mixture towards poor mixture in at least two zones. Gradual combustion is realized by injecting fuel or combustion air to consecutive combustion zones. The United State patent documents no. U.S. Pat. No. 5,195,884, U.S. Pat. No. 5,275,552, U.S. Pat. No. 7,198,482, U.S. Pat. No. 6,695,609 and the International patent document no. WO2010092150 can be cited as an example concerning this issue. In the said patent documents, homogeneous combustion systems wherein fuel supply nozzles are placed in different positions on the combustion chamber in order to realize the gradual combustion.

In homogeneous combustion technique, which is also called as diffusion flame, fuel and oxidant are mixed by means of diffusion and combustion reaction occurs in a combustion chamber wherein heat is also extracted from the system at the same time. Diffusion flame-type burners with reduced $NO_x$ emission are described in the patent documents no. U.S. Pat. No. 4,904,179 and EP1310737.

Another way to reduce $NO_x$ emissions released in combustion reaction is to reduce combustion temperature. Realizing combustion process at low temperatures is possible by only catalytic combustion. Catalytic combustion, which is also known as flameless combustion, occurs on a catalyst surface and with activation energies much lower than homogeneous combustion. In general, precious metal catalysts such as palladium and platinum are used. Chromium, manganese, iron, calcium, nickel, copper, zinc and tin oxides are also metals having oxidation capabilities and they can be used for the purpose of catalytic combustion. Due to the fact that methane, which is an intermediate compound of natural gas, is a highly symmetric molecule; it is required to be pre-heated to a temperature of approximately 250-400° C. in order to be burned catalytically. This pre-heating process affects the energy balance of combustion system in a negative way. In general; the attractiveness of palladium-based combustion catalyst is lost due to the fact that the PdO active sites of these catalysts are transformed into inactive metallic phase over 800° C.

The U.S. Pat. No. 5,464,006 and U.S. Pat. No. 5,810,577 disclose catalytic combustion systems in stages. In the U.S. Pat. No. 5,464,006, combustion takes place in two different catalytic combustion stages after the mixture of gas-fuel-air is passed through an electrical pre-heating zone. Approximately 70-90% of the fuel is burned in the first catalytic zone (catalytic gap burner tube) while the rest of the combustion takes place in the second catalytic zone and on a monolith-type catalyst. A similar application is also available in the U.S. Pat. No. 5,810,577.

The European Patent documents no. EP0256322 and EP0356709 disclose a heat exchange system which is immersed into a catalyst bed. Mixture of natural gas-air is heated to the temperature (320-390° C.) where catalytic combustion starts by means of an electrical heater or an electrical ignition system enabling homogeneous combustion in the beginning. After the catalytic combustion starts, combustion temperatures reach 400-700° C. and the said pre-heating systems are deactivated. Catalytic combustion reaction is over when the temperature decreases below 400 C. Pre-heating systems are temporarily re-activated for restart. Copper chromite is used as catalyst.

In the German Patent document no. DE3332572, combined surface and catalytic type burners are utilised in two consecutive combustion stages. In the first stage, primary combustion takes place on the combined (surface-catalytic) burner located in a position parallel to the second stage burner. The combustion system is completed, with a supplementary secondary air supply to the combustion gas leaving the first zone, by the identical second surface-catalytic combined burner system located in the lower part of the same reactor. The water fed to the heat exchanger units, which are located on the outlet of both burner pairs as connected in series, is heated by the heat of combustion gases.

The German Patent documents no. DE4308017, DE422711, DF4412714 and the European Patent document no. EP0671586 disclose systems having three combustion zones wherein surface-type burners and catalytic burners are used together. Combustion is carried out homogeneously by feeding part of the mixture of gas fuel-air into the surface-type burner. Whereas the gas fuel-air mixture, fed into the catalytic burner, is pre-heated over a heating jacket to temperatures of 300-350° C. by the heat generated in the surface-type burner. Thereby, the gap-type catalytic burner is activated. Lastly, the combined exhaust gases coming from both burners (surface-type burners, gap-type catalytic burner) enter the monolith-type catalytic burner and the combustion process is completed. The fuel having thermal energy of approximately 13 kW is burnt on a homogeneous surface-type burner while the remaining mixture of fuel-air is burnt catalytically by modulation in a thermal energy range of 6-12 kW. Hot water is obtained by providing water circulation in the chamber surrounding all three burners.

In the German Patent document no. DE19739704, two catalytic burners are used consecutively. The first catalytic burner unit is a ceramic block and it is also used as surface burner at the same time. On the inlet and outlet of the surface and catalytic burners, there are two heat exchanger units in series. The heat exchanger located in the burner inlet is designed so as to receive the heat emitted by radiation to prevent the flame to back fire. In addition, an amount of the heat composed is taken from the combustion chamber by the cooling water circulation wrapping the outside of the burning block.

In the European Patent document no. EP0789188, two catalytic burners are positioned consecutively in a similar way. There is one ignition electrode in the chamber between the two catalytic burners. Combustion process is initiated by the homogeneous combustion taking place on the first catalyst surface by means of the ignition electrode at first. In order to prevent the catalysts from being overheated, cooling plates with IR-radiation absorption layers are placed on both sides of the chamber where the ignition electrode is located. Combustion is completed by burning the fuel fraction, which is not burnt in the first catalytic burner, in the second catalytic burner with monolith geometry. The ignition electrode, which is described in the said patent document used for first ignition, can be positioned in the zone remaining in between the two catalytic burners and it can also be positioned in the zone remaining in between the cooling-distribution plate put to the side of gas supply and the first catalytic combustion plate. Alternatively in the patent document it is described that it is possible to place the two units of the system, which consists of the ignition electrode positioned in the zone in between the two catalytic burners and the catalytic burners, parallel to each other.

In the German Patent document no. DE4324012, homogeneous combustion and catalytic combustion are carried out successively. Exhaust gases and unburned hydrocarbons occurring as a result of homogeneous combustion are passed over a catalytic type burner plate and thereby exhaust gases with reduced emission are taken out from the unit to the exhaust pipe. The actual combustion occurs in the homogeneous burner. The catalytic burner is used with the purpose of oxidizing volatile organic compounds to provide an improvement in exhaust gas emissions. In this system proposed, there is no heat exchanger for hot water production.

The U.S. Pat. No. 5,851,489 discloses a diffusion-type catalytic combustion system. Fuel is diffused into the support structure, where the catalyst is impregnated, from the inner part while air is diffused from the outer surface on the same structure. Catalytic combustion occurs on the catalyst support structure and temperatures reach 400-750 C. A liquid (for example: water) can be heated by means of a heat jacket placed to the section remaining in between the surfaces.

In the U.S. Pat. No. 6,431,856, the pre-mixed mixture of fuel-air is fed into the combustion chamber. Homogeneous combustion is initiated by means of an ignition electrode located in the entry of the combustion chamber and the catalyst block is pre-heated to a desired temperature. After the catalyst block is heated to the temperatures where catalytic combustion will start, the mixture of fuel-air is interrupted and it is ensured that the flame is extinguished. Catalytic combustion starts on the hot catalytic surface by re-feeding the mixture of fuel-air one after the other while the ignition electrode is deactivated. Whereas the water, which is circulated from the heat exchanger, located behind the catalytic burner and in the exhaust line, is heated by means of exhaust gases.

The U.S. Pat. No. 7,444,820 discloses a two-stage catalytic combustion process for gas turbines. Catalytic combustion is carried out by the rich mixture from the first catalytic combustion unit. Temperature of the hot air exiting the compressor is sufficient in order to reach the temperatures where catalytic combustion starts by rich mixture. As a result of the combustion occurring in the first catalytic burner by rich mixture, hot gas fuel (with $H_2$,CO content) comprising flammable hydrocarbon components occur due to the fact that complete combustion does not happen. Part of the heat, which occurs as a result of rich combustion, is transferred over the heat exchanger to the combustion air and the secondary combustion air is heated for poor combustion. Partially oxidized hydrocarbons are mixed with the secondary combustion air, such that a poor mixture will be formed and complete combustion is carried out in the secondary catalytic combustion unit.

In the U.S. Pat. No. 5,052,919, a two-stage homogeneous combustion is carried out. During the coal gasification process a gas with high ammonia content occurs in the coal gasification process. A high amount of $NO_x$ emission occurs as a result of burning this ammonia-containing gas under stoichiometric conditions. In order to reduce the $NO_x$ emissions, a two-stage homogeneous combustion is described in the said patent. An important part of the fuel is burned under rich combustion conditions at lambda values of 0.6 to 0.9.

SUMMARY OF THE INVENTION

An objective of the present invention is to realize a combustion system wherein rich combustion in the rich homogeneous combustion unit located in the first zone and poor combustion in the poor catalytic combustion unit located in the second zone are carried out consecutively and thus zero $NO_x$ emission is ensured.

Another objective of the present invention is to realize a combustion system wherein heat exchangers units are located in outlets of the rich homogeneous combustion unit and the poor catalytic combustion unit, the said units are interconnected in series, and the heat generated in combustion reactions is transferred into domestic radiator heating water and/or tap water.

Another objective of the present invention is to realize a combustion system wherein there is also one more heat exchanger unit in order to pre-heat the secondary air supply of the poor mixture to the temperatures where catalytic combustion occurs.

Another objective of the present invention is to realize a combustion system which has a moisture holding unit that captures the water vapour condenses on cold catalyst surface at the initial stage of the combustion system and wherein the damage of the catalyst structure due to the vapour condensation is prevented.

Another objective of the present invention is to realize a combustion system which constitutes an alternative to the domestic water heating systems.

Another objective of the present invention is to realize a combustion system which meets the additional heating load required in micro-cogeneration systems and provides heat recovery by burning the combustible waste gas occurring in micro-cogeneration systems.

Figure 1:
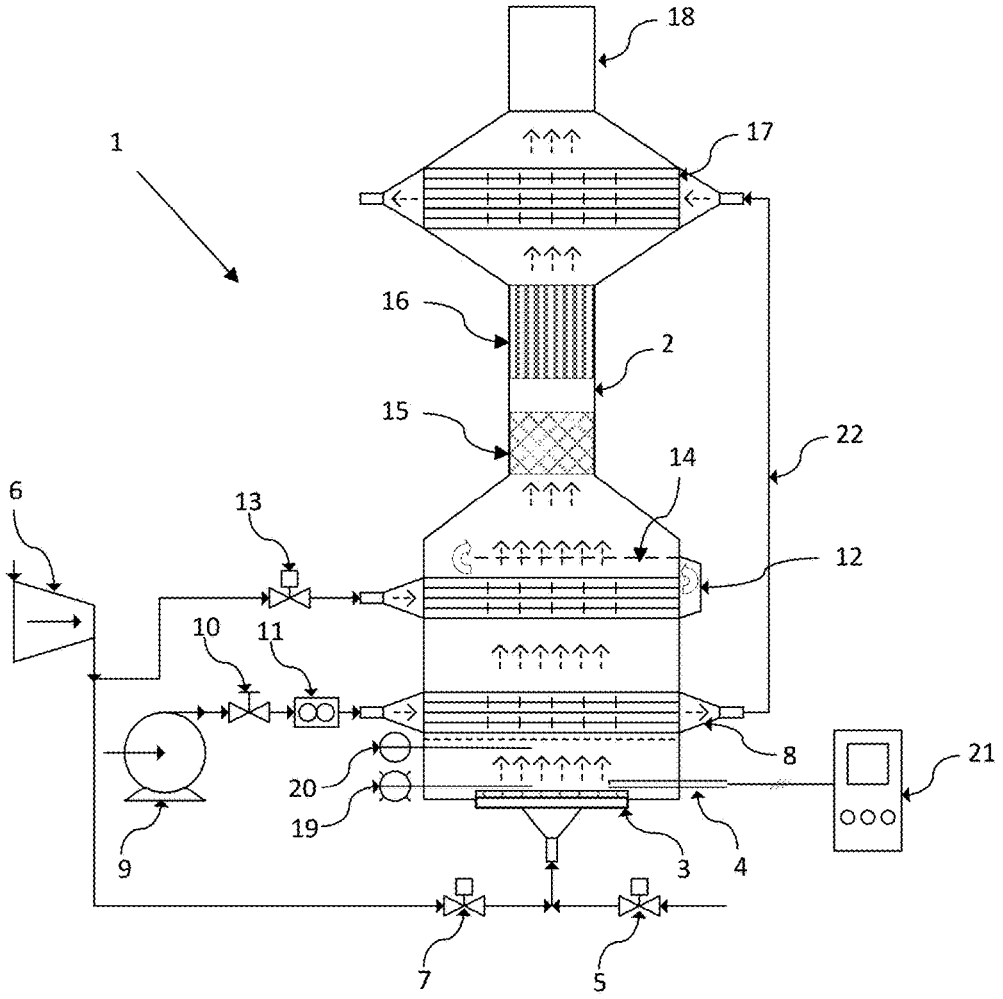
FIG. 1 is a schematic view of the inventive hybrid homogenous-catalytic combustion system.

The components illustrated in the figures are individually numbered, where the numbers refer to the following:

1. Combustion system
2. Body
3. Surface-type burner
4. Electrode
5. Fuel valve
6. Compressor
7. Air valve
8. Primary heat exchanger
9. Pump
10. Heat exchanger valve
11. Flow meter
12. Secondary heat exchanger
13. Secondary heat exchanger air valve
14. Gas distributor plate
15. Moisture trap
16. Catalytic burner
17. Tertiary heat exchanger
18. Exhaust pipe
19. Ionization electrode
20. Thermocouple
21. Control unit
22. Pipe line

DETAILED DESCRIPTION OF THE INVENTION

"A Hybrid Homogenous-Catalytic Combustion System" realized to fulfil the objectives of the present invention is illustrated in the accompanying figures, in which:

The inventive hybrid homogenous-catalytic combustion system (1) essentially comprises:

at least one body (2);
at least one surface-type burner (3) which is located on the lower part of the body (2) and wherein the rich fuel air mixture is burnt;
at least one electrode (4) which ignites the fuel air mixture;
at least one fuel valve (5) whereby the natural gas required for the surface-type burner (3) is given;
at least one compressor (or fan) (6) whereby the air required for the surface-type burner (3) is provided;
at least one air valve (7) which is located upstream of the compressor (6);
at least one tubular primary heat exchanger (8) where the exhaust gases, which are generated as a result of the combustion occurring in the surface-type burner (3), enter and the heating water passes through;
at least one pump (9) to pressurize the water passing through the primary heat exchanger (8);
at least one heat exchanger valve (10) which is located in front of the primary heat exchanger (8) and at least one flow meter (rotameter, etc.) (11) which measures the water flow;
at least one tubular secondary heat exchanger 12) which is positioned on the upper part of the primary heat exchanger (8), where the exhaust gases exiting the primary heat exchanger (8) passes from the heating jacket and the air pumped for combustion passes through thereof by being heated;
at least one secondary heat exchanger air valve (13) which controls the air passing through the secondary heat exchanger (12);
at least one gas distributor plate (14) which is located on the upper part of the secondary heat exchanger (12) and generates the poor gas mixture by mixing the exhaust gas and the air exiting the secondary heat exchanger (12)
at least one moisture trap (15) where the poor gas mixture exiting the gas distributor plate (14) enters;
at least one catalytic burner (16) which is located on the upper part of the moisture trap (15) and wherein flameless combustion occurs;
at least one tertiary heat exchanger (17) where the gas leaving the catalytic burner (16) is released to the atmosphere by passing through the jacket part and the water exiting the primary heat exchanger (8) passes through for the last time before leaving the system; and
at least one gas outlet exhaust pipe (18) where the gas leaves the body (2).

The inventive combustion system (1) also comprises at least one ionization electrode (19) which controls presence of flame in the surface-type burner (3) continuously. Apart from this, the combustion system (1) comprises at least one thermocouple (20) which measures the flame temperature on the surface-type burner (3). The system (1) also comprises at least one control unit (21) which triggers the ignition electrode (4) in order to ignite the rich fuel-air mixture in the surface-type burner (3).

In a preferred embodiment of the invention, combustion occurs in the surface-type burner (3) at lambda values under stoichiometric conditions. In the said burner (3), rich natural gas-air mixture is generated by means of the fuel valve (5) and the air valve (7) and it is ignited by means of the ignition electrodes (4). In the surface-type burner (3), a rich combustion is realized in the range of stoichiometric combustion wherein lambda is 1 and rich combustion wherein lambda is 0.6. A gas mixture having a content of minimum 4% carbon monoxide and 4% hydrogen in volume is obtained as a result of the homogenous rich combustion (partial oxidation) occurring in the surface-type burner (3).

In the inventive combustion system (1), there is a pipe line (22) which is provided in order to deliver the water between the primary heat exchanger (8) and the tertiary heat exchanger (17). Thus, the water heated by the surface-type burner (3) in the primary heat exchanger (8) is delivered to the tertiary heat exchanger (17) to realize further heating by means of the catalytic burner (16). In a preferred embodiment, while the water passes through the pipes of the primary and tertiary heat exchangers (8, 17), the air generating the poor gas mixture is supplied to the catalytic burner (16) from the secondary heat exchanger (12) by being mixed with the exhaust gas.

In the invention, the water flow heated by the combustion gases in the primary and tertiary heat exchangers (8, 17) is used as domestic heating water. A thermal load of 5 $kW_t$ to 20 $kW_t$ is transferred to the said water in the primary heat exchanger (8).

In a preferred embodiment of the invention, the gas distributor plate (14) does not entirely extend inside the body (2) from one end to the other end and form an opening wherein the gas mixture can pass (2). In addition, the said plate (14) has a hollow structure. Thus, the gas mixture reaches the moisture trap (15) easily from both the holes and the aperture and proceeds to catalytic burner (16) through here. The gas mixture reaching the catalytic burner (16) contains hydrogen and carbon monoxide ($H_2$—CO) generated as a result of rich combustion in the surface-type burner (3). The exhaust gas of the catalytic burner composed of carbon dioxide, oxygen and nitrogen as a result of flameless combustion occurring in the catalytic burner (16). The achieved temperature of the gas with poor fuel content through the gas distributor plate (14), is the minimum temperature required for initiation of catalytic reaction.

In a preferred embodiment of the invention, the gas mixture passes through the moisture trap (15) both during the start-up and normal operation of the system (1). The moisture trap (15) captures the water condensing during the start-up of the system (1). Whereas during continuous operation, the moisture kept by the ambient temperature vaporizes and becomes regenerated.

The gas mixture, which is burned by means of flameless combustion in the catalytic burner (16), gives thermal energy of between 5 $kW_t$ and 15 $kW_t$ to the inventive combustion system (1). By means of the serially interconnected primary and tertiary heat exchanger units (8, 17) in series, the water flow leaves the hybrid combustion system (1) by extracting thermal energy of between 10 $kW_t$ and 30 $kW_t$. In a preferred embodiment of the invention, thermal energies of the primary, secondary and tertiary heat exchangers (8, 17) vary depending on the amount of fuel, air and water supplied to the combustion system (1). The inventive combustion system (1) provides a modulation range of 10 $kW_t$ to 30 $kW_t$. Depending on the place and purpose of use of the combustion system (1), the modulation range and the minimum/maximum thermal loads extracted can vary and this is included within the scope of the present invention.

In the inventive combustion system (1), firstly natural gas is supplied to the system (1) by means of the fuel valve (5). Whereas the air required for combustion is sent to the surface-type burner (3) by the compressor (6) and the air valve (7) positioned upstream the compressor (6). Using the fuel valve (5) and the air valve (7), a rich natural gas-fuel mixture is generated in the inlet of the burner (3). This mixture is burned in the surface-type burner (3) and a partially oxidized gas comprising $H_2$, CO and low amount of unburned $CH_4$ is generated. Initiation of the combustion is ensured by the ignition electrode (4). Presence of continuous flame is controlled by the ionization electrode (19) in the invention whereas flame temperature is measured by means of a thermocouple (20). The exhaust gas generated in the surface-type burner (3) heats the water flow passing through the pipes while it passes through the jacket part of the primary heat exchanger (8). The water to the primary heat exchanger (8) is pumped by means of a pump (9) and flow is controlled by the valve (10). Flow of the water to be given to the heat exchanger (8) is adjusted by the flow meter (1) and the water heated is transferred to the tertiary heat exchanger (17) over the pipe line (22). The exhaust gases leaving the primary heat exchanger (8) pass through the jacket part of the secondary heat exchanger (12). Exhaust gases heat the air supplied to the secondary heat exchanger (12), by means of the compressor (6), and the amount supplied is adjusted by means of the secondary heat exchanger air valve (13). The air heated is mixed with the combustible exhaust gas passing through the secondary heat exchanger (12) and thus the gas mixture with poor fuel content is composed in the zone remaining under the gas distributor plate (14). The gas mixture reaches the moisture trap (15) by passing through the holes of the distributor plate (14) and the aperture. The gas mixture with $H_2$ and CO content passing through the moisture trap (15) burns by flameless combustion the exhaust gases generated pass through the jacket part of the tertiary heat exchanger (17) and released to the atmosphere by means of the exhaust pipe.

In the inventive system (1), $NO_x$ emissions of the homogenous type combustion reaction occurring in the surface-type burner (3) in the exhaust gas released to the atmosphere reduce to trace amounts as it is proceeded from the stoichiometric combustion (lambda value 1) to the rich combustion (lambda value 0.6). Whereas the water flow exiting the primary heat exchanger (8) leaves the system (1) upon being heated further in the tertiary heat exchanger (17).

Part of the heat released as a result of rich combustion by the inventive combustion system (1) is used to obtain hot water using the heat exchangers (8, 17), in other words for obtaining 50° C. domestic radiator and/or tap water. Both at the surface-type burner (3) outlet and the catalytic burner (16) outlet, there are heat exchangers (8, 17) interconnected in series. Water flow to be delivered to the radiators for the purpose of domestic heating extracts a heat of 20 $kW_t$ in average from the primary and tertiary heat exchangers (8, 17). Approximately half of this thermal load is provided from the heat of the gases of the partial oxidation product as a result of rich combustion and this heat is transferred to the water over the primary heat exchanger (8). Whereas half of the thermal load obtained in the combustion system (1) is obtained in the catalytic burner (16) and the heat obtained is transferred to the radiator side over the tertiary heat exchanger (17) which is connected to the primary heat exchanger (8) in series. In the inventive combustion system (1), the primary heat exchanger (8) and the tertiary heat exchanger (17) are used for the purpose of water heating whereas there is a secondary heat exchanger (12) used for the heat exchange between the gas and the secondary air. The combustion air passing through the secondary heat exchanger (12) is heated in the tubular-type heat exchanger by the heat of the partial oxidation product leaving the rich combustion zone.

The gas with $H_2$—CO content released as a result of the rich combustion by means of the inventive combustion system (1) is mixed with the combustion air pumped by the compressor (6) in the outlet of the secondary heat exchanger (12) and poor fuel combustion mixture is obtained. By adjusting the heat extraction capacity of the primary heat exchanger (8) used for water heating the thermal load of the secondary heat exchanger (12) used for air heating could be adjusted to achieve the minimum temperature of the air-fuel mixture transferred to the catalytic burner (16), where catalytic combustion can initiate.

Besides, according to demand hot water required for radiator domestic heating systems operating between the inlet/outlet temperatures of 30-50 C/60-80° C. can be provided by the combustion system (1). In addition to production of domestic hot water, the present invention is also used as an initial burner or as a couple of initial burner-final burner in systems generating hydrogen from natural gas by catalytic reforming methods.

It is possible to develop various embodiments of the inventive hybrid homogenous-catalytic combustion system (1) therefore it cannot be limited to the examples disclosed herein, the system is fundamentally as it is described in the claims

What is claimed is:

1. A combustion system comprising: a body; a surface-type burner which is located on a lower part of the body where a rich fuel air mixture is burnt; an ignition electrode which ignites the rich fuel air mixture; a fuel valve whereby natural gas required for the surface-type burner is given; a compressor or fan whereby air required for the surface-type burner is provided; an air valve which is located downstream of the compressor; wherein a primary heat exchanger, where exhaust gases, which are-generated as a result of a combustion occurring in the surface-type burner, enter and heat water passing through; a pump to pressurize the water passing through the primary heat exchanger; a heat exchanger valve which is located in front of the primary heat exchanger and a flow meter which measures water flow; a tubular secondary heat exchanger which is positioned on an upper part of the primary heat exchanger, passing through a jacket part of the tubular secondary heat exchanger, thereby heating secondary air pumped for the combustion through the tubular secondary heat exchanger; a secondary heat exchanger air valve which controls the air passing through the secondary heat exchanger; a gas distributor plate which is located on an upper part of the secondary heat exchanger and generates poor gas mixture by mixing the exhaust gases and the air exiting the secondary heat exchanger; a moisture trap where the poor gas mixture exiting the gas distributor plate enters; a catalytic burner which is located on an upper part of the moisture trap wherein a flameless combustion occurs; a tertiary heat exchanger where gas leaving the catalytic burner is released to atmosphere by passing through a jacket part and water exiting the primary heat exchanger passes through and heated for the last time before leaving the system; a gas outlet exhaust pipe where the gas leaves the body.

2. The combustion system according to claim 1, wherein an ionization electrode controls a presence of a flame in the surface-type burner continuously.

3. The combustion system according to claim 1, wherein a thermocouple measures the flame temperature on the surface-type burner.

4. The combustion system according to claim 2, wherein a control unit triggers the ignition electrode in order to ignite the rich fuel air mixture in the surface-type burner.

5. The combustion system according to claim 1, wherein in the surface-type burner, a rich natural gas-air mixture is generated by means of the fuel valve and the air valve and the rich natural gas-air mixture is ignited by means of the ignition electrode.

6. The combustion system according to claim 1, wherein a pipe line is provided in order to deliver the water between the primary heat exchanger and the tertiary heat exchanger.

7. The combustion system according to claim 1, wherein the gas distributor plate does not entirely extend inside the body from an end to an other end therefore forming an opening wherein the poor gas mixture can pass throughout the body.

8. The combustion system according to claim 1, wherein the gas distributor plate has a hollow structure.

9. The combustion system according to claim 1, wherein in the moisture trap, the poor gas mixture passes both during start-up and normal operation of the combustion system.

10. The combustion system according to claim 2, wherein a thermocouple measures the flame temperature on the surface-type burner.

11. The combustion system according to claim 2, wherein in the surface-type burner, a rich natural gas-air mixture is generated by means of the fuel valve and the air valve and the rich natural gas-air mixture is ignited by means of the ignition electrode.

12. The combustion system according to claim 3, wherein in the surface-type burner, a rich natural gas-air mixture is generated by means of the fuel valve and the air valve and the rich natural gas-air mixture is ignited by means of the ignition electrode.

13. The combustion system according to claim 2, wherein a pipe line is provided in order to deliver the water between the primary heat exchanger and the tertiary heat exchanger.

14. The combustion system according to claim 3, wherein a pipe line is provided in order to deliver the water between the primary heat exchanger and the tertiary heat exchanger.

15. The combustion system according to claim 2, wherein the gas distributor plate does not entirely extend inside the body from an end to an other end therefore forming an opening wherein the poor gas mixture can pass throughout the body.

16. The combustion system according to claim 3, wherein the gas distributor plate does not entirely extend inside the body from an end to an other end therefore forming an opening wherein the poor gas mixture can pass throughout the body.

17. The combustion system according to claim 2, wherein the gas distributor plate has a hollow structure.

18. The combustion system according to claim 3, wherein the gas distributor plate has a hollow structure.

19. The combustion system according to claim 2, wherein in the moisture trap, the poor gas mixture passes both during start-up and normal operation of the combustion system.

20. The combustion system according to claim 3, wherein in the moisture trap, the poor gas mixture passes both during start-up and normal operation of the combustion system.

* * * * *